US006554257B1

(12) United States Patent
Kenton

(10) Patent No.: US 6,554,257 B1
(45) Date of Patent: Apr. 29, 2003

(54) SAFETY RAIL SYSTEM

(76) Inventor: Gregory S. Kenton, 5964 Idlewood Rd., Mound, MN (US) 55364

( * ) Notice: Subject to any disclaimer, the term of this patent is extended or adjusted under 35 U.S.C. 154(b) by 0 days.

(21) Appl. No.: 09/595,794

(22) Filed: Jun. 16, 2000

(51) Int. Cl.[7] ..... E04H 17/16
(52) U.S. Cl. ..... 256/24; 256/65.14
(58) Field of Search ..... 256/56, 24, 65.14, 256/65.01, 59

(56) References Cited

U.S. PATENT DOCUMENTS

| | | | | | |
|---|---|---|---|---|---|
| 2,517,386 | A | * | 8/1950 | Cooper | 256/25 |
| 2,895,717 | A | * | 7/1959 | De Falco | 256/25 |
| 3,020,023 | A | * | 2/1962 | MacIntyre | 256/24 |
| 3,469,822 | A | | 9/1969 | O'Brien | |
| 3,740,022 | A | | 6/1973 | DiGiovanni | |
| 3,776,521 | A | | 12/1973 | Weinert | |
| 3,931,700 | A | | 1/1976 | Scanni et al. | |
| 4,015,826 | A | | 4/1977 | Lauzier | |
| 4,645,183 | A | | 2/1987 | Rattray et al. | |
| 4,787,475 | A | | 11/1988 | Arteau et al. | |
| 4,787,603 | A | | 11/1988 | Norton | |
| 5,161,784 | A | | 11/1992 | Sader | |
| 5,362,030 | A | | 11/1994 | Iler, Jr. et al. | |
| 5,518,337 | A | | 5/1996 | Moldin | |
| 5,547,169 | A | | 8/1996 | Russell | |
| 5,609,327 | A | | 3/1997 | Amidon | |
| 5,779,227 | A | | 7/1998 | Elkins et al. | |
| 5,816,554 | A | * | 10/1998 | McCracken | 248/346.01 |
| 5,842,685 | A | * | 12/1998 | Purvis | 256/67 |
| 6,220,577 | B1 | * | 4/2001 | Ostrow | 256/67 |
| 2001/0006231 | A1 | * | 7/2001 | McCracken | 256/59 |

* cited by examiner

*Primary Examiner*—Lynne H. Browne
*Assistant Examiner*—John R. Cottingham
(74) *Attorney, Agent, or Firm*—Hugh D. Jaeger

(57) ABSTRACT

An improved portable safety guardrail system which utilizes cast iron bases or welded bases and tubular guardrail sections and gates. The system is designed to meet and exceed OSHA Fall Protection Regulations while having the appeal of being modular and portable with no need for anchoring devices (i.e., anchor bolts, etc.). This invention allows for infinite configuration of a guardrail system to suit the needs of the user.

15 Claims, 8 Drawing Sheets

SAFETY RAIL SYSTEM

CROSS REFERENCES TO CO-PENDING APPLICATIONS

None.

BACKGROUND OF THE INVENTION

1. Field of the Invention

This invention pertains to a safety rail system for providing a protective barrier for blocking access to a hazardous area or for preventing falls from an elevated area.

2. Description of the Prior Art

Prior art safety rail systems required the user to secure components of the systems by some type of securing method, such as by using anchor bolts or by welding pieces together. One similar prior art system to this invention utilizes cast bases and rail sections. This system uses two post receivers on each cast base to support only two rail sections. In each post receiver are four cast holes spaced 90 degrees from one another. These holes are used to secure the rail sections to the base with some type of securing pin. In contrast, the present invention utilizes a plurality of offset slots instead of holes to provide for infinite positioning.

A common prior art system has toe board receiver slots cast into the perimeter of the base itself, creating protrusions. These protrusions could extend up to six inches from the base surface. In contrast, this invention uses removable toe board adapters. By utilizing the adapter method, potential hazards due to protrusions extending from the base are eliminated. One hazard is a potential tip-over of a forklift driving over the protrusion. Another potential hazard is human injury should someone trip over the protrusion and fall. These protrusions also become a nuisance when toe boards are not in use.

No known system allows for infinite positioning and in addition has locking gates and removable toe board adapters. The present invention provides for all three of these features inclusive or independent.

SUMMARY OF THE INVENTION

The general purpose of the present invention is to provide a safety rail system which is intended to be used to cordon off work areas and the like where human safety is an issue. When the cast iron base is coupled to the rail and/or gate sections, it has enough weight, mass and strength to withstand tipping. Thus, the system provides a safe means of protection should one fall against it. It also meets and exceeds OSHA regulations for permanent safety railings. When used on an elevated work surface, optional toe board adapters are added. These adapters enable the system to be in accordance with OSHA regulations pertaining to elevated work areas.

The base is the vital component of this invention and enables the system to be as versatile as it is described herein. The base has four post receivers so as to enable as many as four rail sections, latching posts, or gate posts to be incorporated at any one time. Thus, the system has the versatility to have up to four quadrants of work areas to be defined by the base placement. The base also incorporates four symmetrically positioned holes to enable a permanent mount to a surface, via some form of anchor bolts, if desired.

Designed into each of the post receivers are strategically positioned slots. These slots will align with two vertically spaced holes in the vertical posts of the rail sections. This alignment will enable the rail sections to be secured to the base at infinite positions along a 360° rotation with some type of locking pin.

The rail sections used in this invention come in varying lengths and are comprised of iron tubing with a sufficient wall thickness to withstand the potential force that could be exerted when a person falls against a rail section. It is to be understood that aluminum or another appropriate material may be used in the rail section construction. The rail sections include a rail-locking system that adds additional strength to the entire system, preventing tipping. The vertical posts of each rail section have doughnut-shaped metal pieces (securing rings) welded at equal heights from the bottoms of the posts. The securing rings have precise internal cutouts that enable each rail section to be secured to each other with some type of securing means. A carabiner or locking safety chain would be sufficient to additionally secure the rail sections together. The internal cutouts enable the rail sections to be secured to one another at infinite directions of any rail section that is incorporated in the base at any one time.

This invention incorporates a derivative of the rail section. It is a gate assembly that is utilized to access a work area without having to remove locking pins and a rail section to gain access. A coupler is designed to attach and lock a gate post to a base post receiver. This feature is important so it can lock the angle of assembly of the gate post to the base. Without the coupler, the gate post would move within the post receiver slots and then would not align with the gate latching post after moving from its original installation position.

When this invention is used on an elevated work surface, as defined by OSHA regulations, an adapter or receiver for required toe boards is available. Toe boards are intended to keep objects from being kicked over the elevated work surface that may cause injury to someone below. These toe board adapters or receivers slide onto the lower ends of the vertical posts of each rail section and then are lowered onto the toe board. After positioning onto the toe board, the adapters are secured to the rail section with a securing bolt or knob of one's choice. The toe boards are then secured to the adapter by nails or by a locking pin that is similar to or the same as that used to secure the rail section to the base. Because these adapters are designed to rotate on the vertical post before being locked into place, they can be positioned in any direction so that they follow the in-line path of the rail section itself.

This invention comes with an optional number of horizontal cross members or vertical posts that can be welded to the rail sections. This feature enables this portable system to be used in a variety of markets. One example of this feature is the agricultural market. One could specify the requirements of spacing between the horizontal/vertical spacing of the cross members so that animals could not escape from a livestock pen created using this invention.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
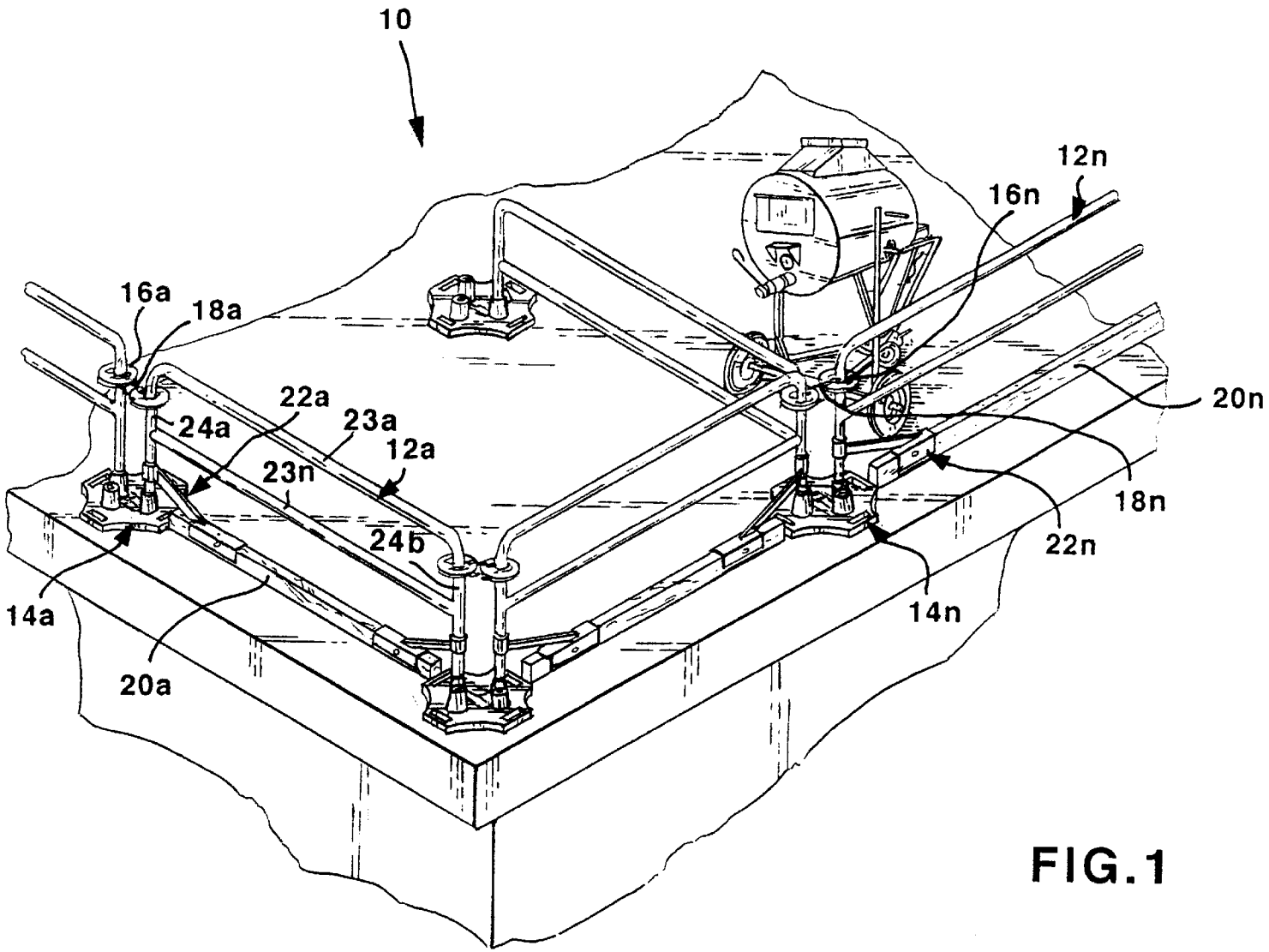
FIG. 1 illustrates a perspective view of a safety rail system, the present invention.

FIG. 1 illustrates a perspective view of a safety rail system 10, the present invention. This illustration shows the safety rail system 10 assembled on a rooftop in a random configuration. The safety rail system 10 is comprised of a plurality of rail sections 12*a*–12*n,* a plurality of bases 14*a*–14*n,* a plurality of rail lock donuts 16*a*–16*n,* a plurality of securing chains 18*a*–18*n,* and a plurality of toe boards 20*a*–20*n* used in conjunction with a plurality of toe board receivers 22*a*–22*n.* Each component will be later described in detail with reference to the following figures.

Figure 2:
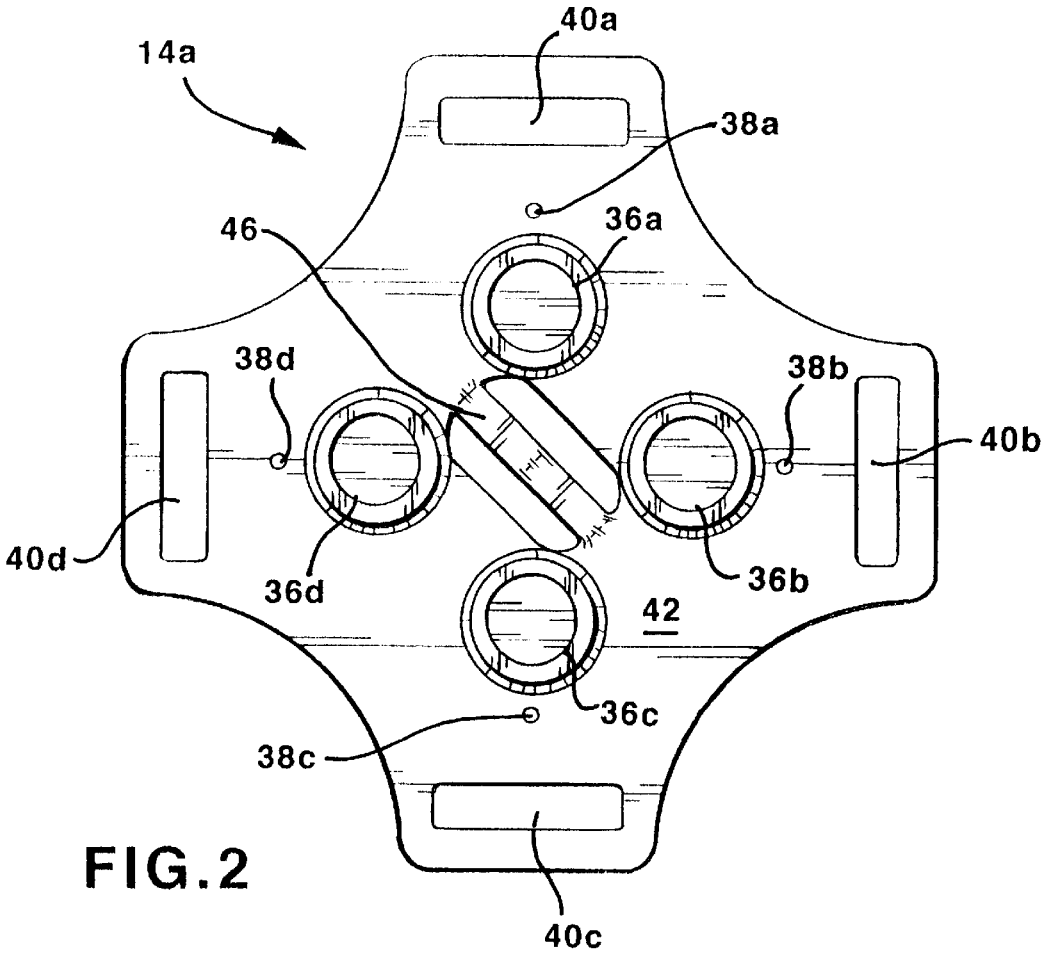
FIG. 2 illustrates a top view of a base.
Figure 3:
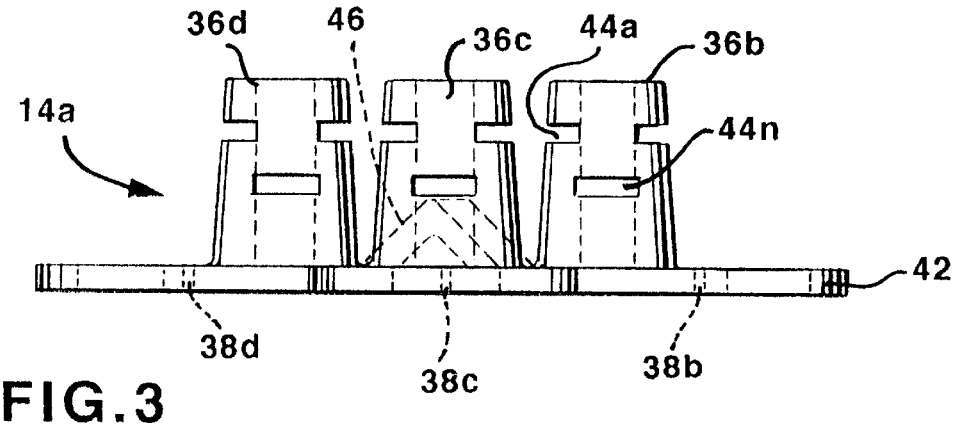
FIG. 3 illustrates a side view of the base.
Figure 4:
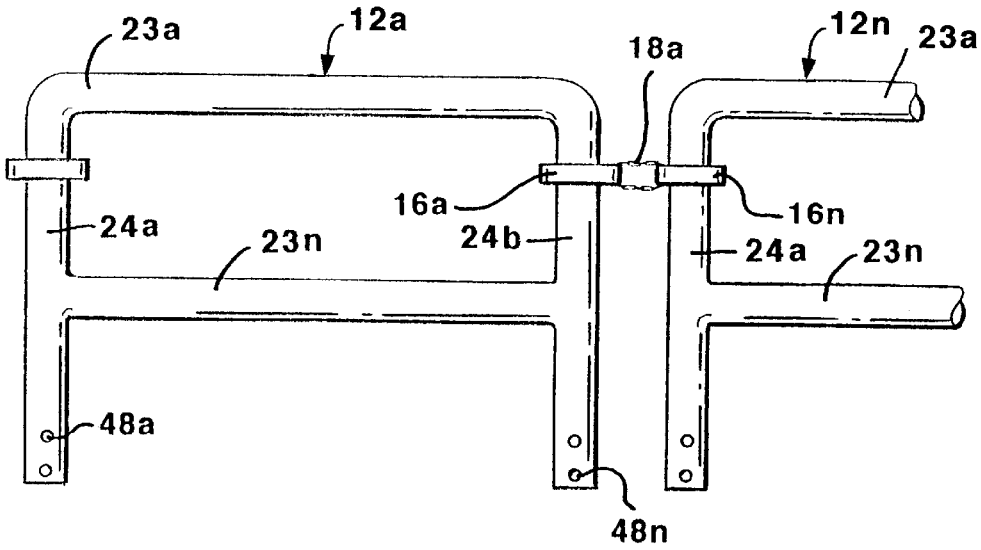
FIG. 4 illustrates a front view of two rail sections connected together using rail lock donuts and a securing chain.

FIG. 2 illustrates a top view of a base 14*a,* and FIG. 3 illustrates a side view of base 14*a.* The bases 14*a*–14*n* weigh between 100–120 lbs. and are cast iron or welded plate and tube to support rail sections 12*a*–12*n* without tipping. Each base 14*a*–14*n* is constructed in the same manner having identical parts including a planar portion 42 with cutouts 40*a*–40*d* on four opposing sides creating built-in handles for transporting it. There is also a centrally located lifting bar 46 which allows the user to hook the bases 14*a*–14*n* to a pulley or a dolly to more easily move the heavy bases 14*a*–14*n.* There are provided holes 38*a*–38*d* which accommodate anchor bolts for securing the bases 14*a*–14*n* to a work surface such as a concrete floor or roof top if permanent mounting is desired. The key feature of the bases 14*a*–14*n* is four post receivers 36*a*–36*d* which extend perpendicularly upward from planar portion 42. Rail sections 12*a*–12*n* are identical and each includes any number of horizontal rails 23*a*–23*n* connected at their ends to vertical posts 24*a*–24*b.* The vertical posts 24*a*–24*b* are positioned in the post receivers 36*a*–36*n* allowing the rail sections 12*a*–12*n* to be positioned in any position in a 360° range. Each of these post receivers 36*a*–36*d* includes a plurality of slots 44*a*–44*n;* and the vertical posts 24*a*–24*b* of the rail sections 12*a*–12*n* incorporate a plurality of corresponding holes 48*a*–48*n,* as shown in FIG. 4, for receiving locking pins 30 (FIGS. 9) to hold the rail sections 12*a*–12*n* in place in the bases 14*a*–14*n* once the desired position is acquired. Once the rail sections 12*a*–12*n* are secured to bases 14*a*–14*n* at each end, the slots will allow the rail sections 12*a*–12*n* to pivot. Each base 14*a*–14*n* may accommodate a maximum of four rail sections 12*a*–12*n* which can be locked in any position within their range of motion. It is to be understood that the slots 44*a*–44*n* may be substituted with multiple holes at different heights, but holes will not allow the infinite 360° range at which the rail sections 12*a*–12*n* may be locked. The post receivers 36*a*–36*d* can also accommodate a latching post and/or a gate post which will be described with reference to FIGS. 4 and 5.

Figure 5:
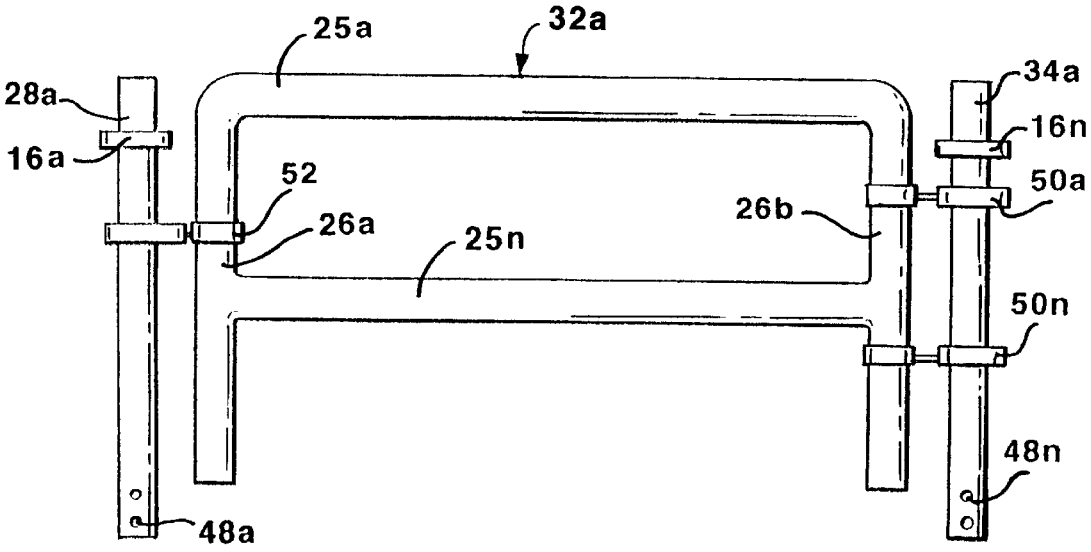
FIG. 5 illustrates a front view of a gate assembly including a gate section in conjunction with a latching post and a gate post.

FIG. 4 illustrates a front view of two rail sections 12*a*–12*n* connected together using rail lock donuts 16*a*–16*n* and a securing chain 18*a,* and FIG. 5 illustrates a front view of a gate assembly which includes a gate section 32*a* in conjunction with a latching post 28*a* and a gate post 34*a.* Each gate section 32*a*–32*n* includes any number of horizontal rails 25*a*–25*n* connected at their ends to vertical posts 26*a*–26*b.* A plurality of latching posts 28*a*–28*n* and a plurality of gate posts 34*a*–34*n* may be used in any configuration. Illustrated in these figures are the holes 48*a*–48*n* which were mentioned in connection with the previous figures. The latching post 28*a* and the gate post 34*a* also incorporate holes 48*a*–48*n* identical to those in the vertical posts 24*a*–24*b* of the rail sections 12*a*–12*n* and these holes serve the same purpose. Also illustrated are hinges 50*a*–50*n* which are secured to the gate post 34*a* in at least two positions. The opposite ends of hinges 50*a*–50*n* secure to the vertical post 26*b* of gate section 32*a,* creating a pivoting gate. The gate section 32*a* also has a gate latch 52 secured on the vertical post 26*a* opposite hinges 50*a*–50*n.* The gate latch 52 provides a locking means for the gate section 32*a.* In the configuration illustrated in FIG. 5, only the gate post 34*a* and the latching post 28*a* are secured to bases 14*a*–14*n* (not illustrated) and gate section 32*a* is suspended between them, creating the operational gate. Both the latching post 28*a* and the gate post 34*a* are locked in position using a locking coupler 54 which will be described with reference to FIGS. 6 and 7. It is necessary to lock the gate post 34*a* in position using the locking coupler 54 to prevent pivoting, keeping hinges 50*a*–50*n* in position.

Figure 6:
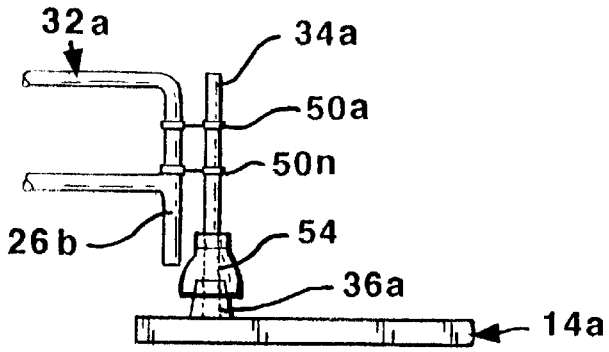
FIG. 6 illustrates a front view of a gate post and gate section where a locking coupler secures the gate post to a post receiver of a base.
Figure 7:
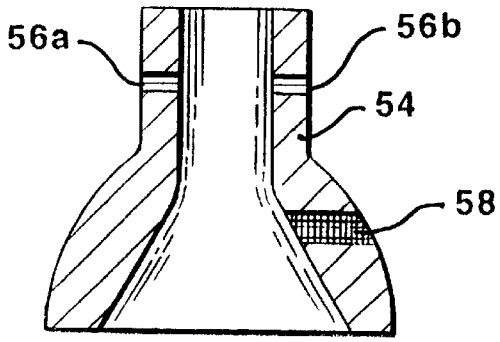
FIG. 7 illustrates a cross sectional view of the locking coupler.

FIG. 6 illustrates a front view of a gate post 34*a* and gate section 32*a* where locking coupler 54 secures gate post 34*a* to post receiver 36*a* of base 14*a,* and FIG. 7 illustrates a cross sectional view of locking coupler 54. Illustrated in particular is the configuration of the safety rail system 10 components when a gate is needed and the locking coupler 54 is used. Also illustrated are a set of holes 56*a* and 56*b* which lock the gate post 34*a* to the locking coupler 54 and a hole 58 which allows the locking coupler 54 to be secured to post receiver 36*a* of base 14*a* by a securing knob, bolt or other suitable device.

Figure 8:
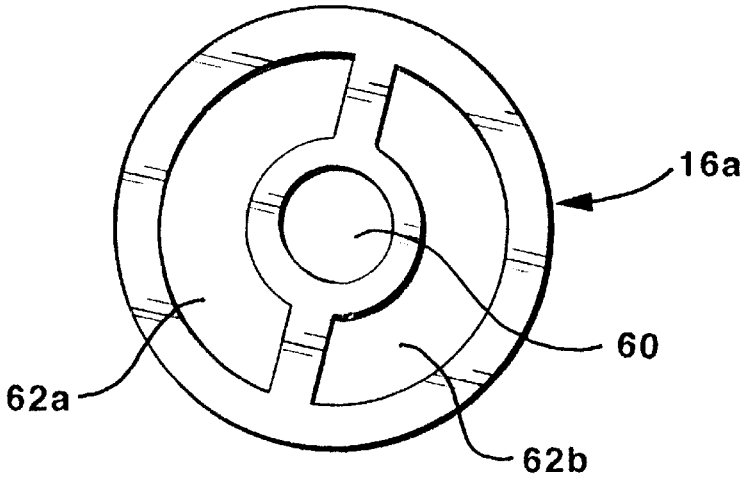
FIG. 8 illustrates a top view of a rail lock donut.

FIG. 8 illustrates a top view of a rail lock donut 16*a.* Illustrated in particular is a hole 60 whereby the rail lock donut 16*a* is secured to vertical post 24*a* or 24*b* of rail section 12*a,* and slots 62*a*–62*b* which accommodate securing chains 18*a*–18*n,* as illustrated in FIGS. 1 and 4.

Figure 9:
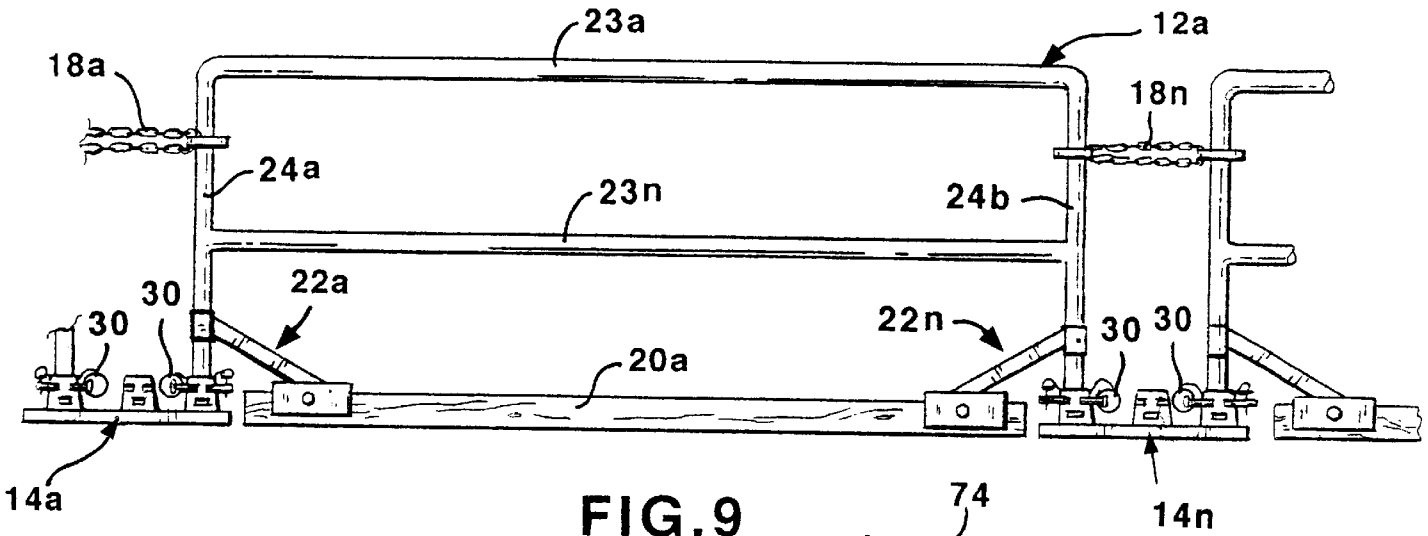
FIG. 9 illustrates a front view of a rail section supported by two bases and incorporating a toe board secured in place by toe board receivers.
Figure 11:
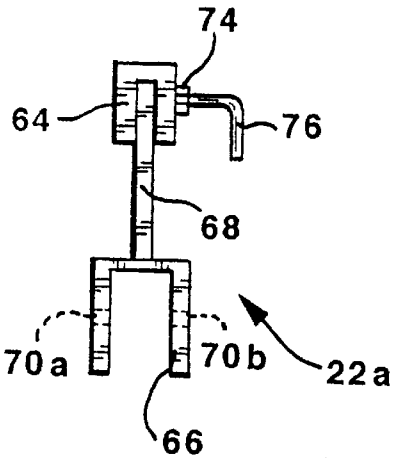
FIG. 11 illustrates a side view of a toe board receiver.
Figure 10:
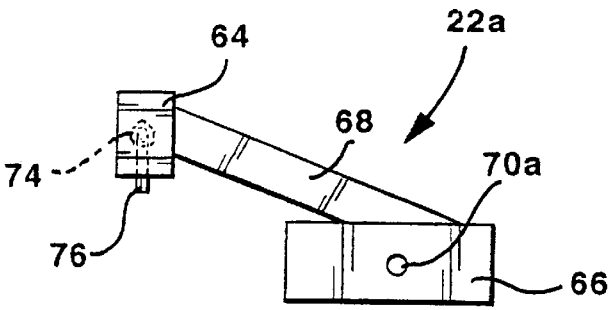
FIG. 10 illustrates a front view of a toe board receiver.

FIG. 9 illustrates a front view of a rail section 12*a* supported by two bases 14*a*–14*n* and incorporating a toe board 20*a* secured in place by toe board receivers 22*a*–22*n,* where all numerals correspond to those elements previously described. With further reference to FIGS. 10 and 11, the use of the toe board will now be described in detail.

FIG. 10 illustrates a front view of a toe board receiver 22*a,* and FIG. 11 illustrates a side view of a toe board receiver 22*a*. Each toe board receiver 22*a*–22*n* includes a sleeve 64 which is slid upwardly over and about the bottom of vertical post 24*a* or 24*b* of rail section 12*a* prior to securing rail section 12*a* to base 14*a*. Each sleeve 64 has a nut 74 welded to the outside over a hole, not illustrated, in the sleeve 64, where an L-bolt 76 or the like is screwed through the sleeve 64 and frictionally engages vertical post 24*a* or 24*b*. The sleeve 64 may also be bolted or welded, if necessary or so desired. There is a board receiver bracket 66 connected at an angle to the sleeve 64 by shaft 68. The board receiver bracket 66 is straddled over toe board 20*a* and appropriately secured thereto through holes 70*a* and 70*b* by a bolt, securing pin or other appropriate means. Each rail section 12*a*–12*n* should include two toe board receivers 22*a*–22*n* and one toe board 20*a*–20*n*, as illustrated, to prevent materials from being kicked off an elevated work area using the safety rail system 10.

Figure 12:
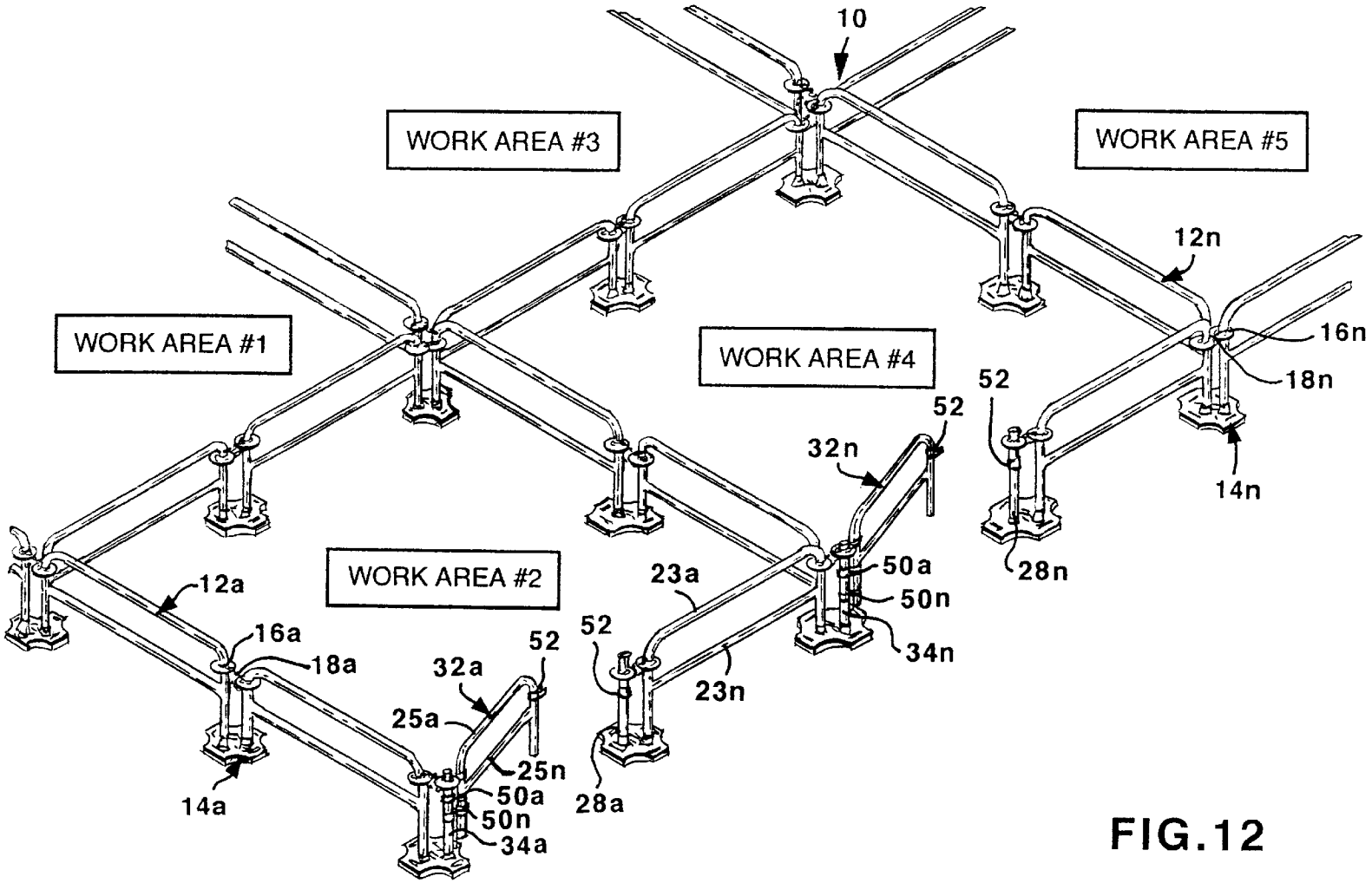
FIG. 12 illustrates a perspective view of the safety rail system configured for use in a manufacturing facility.

FIG. 12 illustrates a perspective view of the safety rail system 10 configured for use in a manufacturing facility, where all numerals correspond to those elements previously described. It defines the use for the four post receivers 36*a*–36*d* that are incorporated into the bases 14*a*–14*n*. Unlimited work areas can be defined with this set-up or one similar to it. Also illustrated is how the gate sections 32*a*–32*n* are used in conjunction with the rail sections 12*a*–12*n*. These gate sections 32*a*–32*n* allow access to the work areas by workers or a forklift, for example. When the gate sections 32*a*–32*n* are not in use, they are closed. When closed, these gate sections 32*a*–32*n* create a safe barrier just as the solid rail sections 12*a*–12*n* would. This illustration shows work areas configured in squares, but it is to be understood that the safety rail system 10 can be configured in any shape needed.

Figure 13:
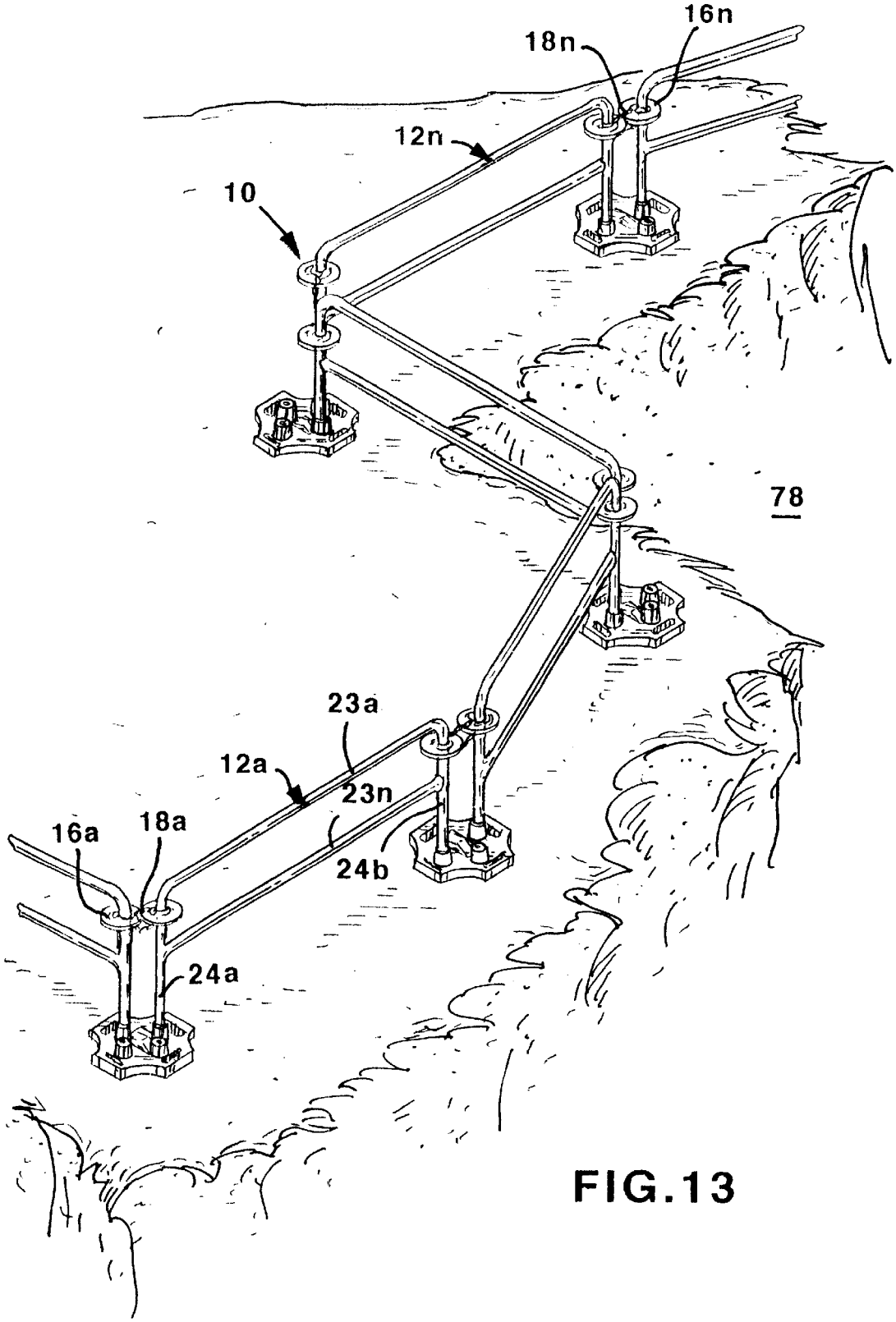
FIG. 13 illustrates a perspective view of the safety rail system constructed around a construction dig site; and, FIG. 14 illustrates a perspective view of a base and rail section depicting how each post receiver has a 360° rotation capacity.

FIG. 13 illustrates a perspective view of the safety rail system 10 constructed around a construction dig site 78. This configuration allows the safety rail system 10 to follow the various angles that are created by the edge of the dig site 78 and still be secured in position by the locking pins 30 (FIG. 9) at any of the angles shown, as well as an infinite number of angles not shown.

Figure 14:
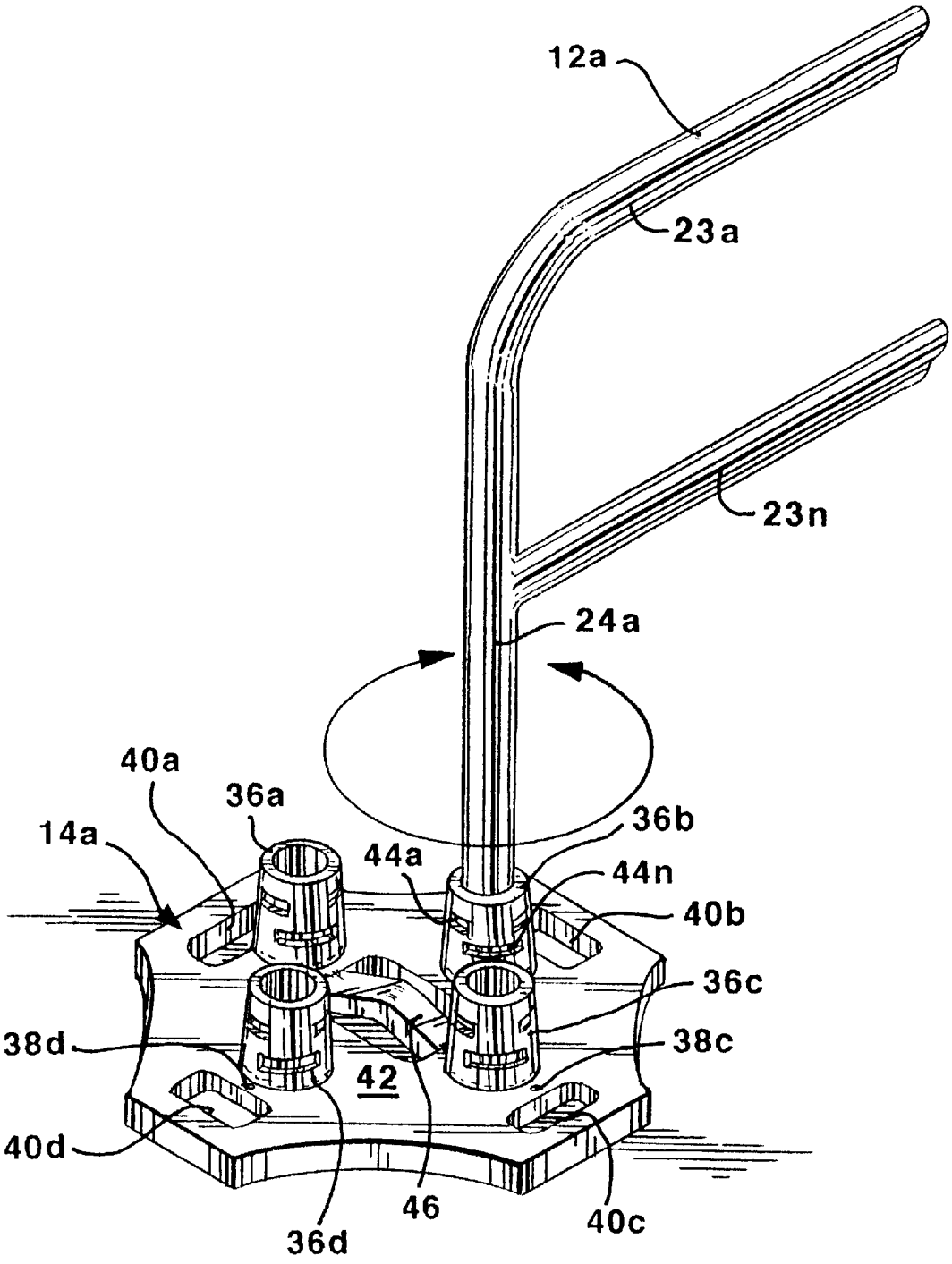

FIG. 14 illustrates a perspective view of a base 14*a* and rail section 12*a* depicting how each post receiver 36*a*–36*d* has the capability to be secured by a locking pin 30 (FIG. 9) to a rail section 12*a*–12*d* in a 360° range when utilizing the slots 44*a*–44*n* in the post receivers 36*a*–36*d*. A plurality of holes at different horizontal planes may be substituted for the plurality of slots 44*a*–44*n*, but the holes would limit the direction the rail sections 12*a*–12*n* could be positioned and not allow the infinite positioning that slots 44*a*–44*n* provide.

MODE OF OPERATION

With reference to FIGS. 1–14, the mode of operation is now described, where all numerals correspond to those elements previously described. The portable safety rail system 10 is comprised of a number of components. The rail sections 12*a*–12*n* come in varying lengths. Secured to the vertical posts 24*a*–24*b* of a rail section 12*a* is a rail-lock donut 16*a*–16*n*. These rail lock donuts 16*a*–16*n* are secured at equal heights on all rail sections 12*a*–12*n* by welding or other appropriate means. When the rail sections 12*a*–12*n* are secured in position and the rail lock donuts 16*a*–16*n* are coupled with a securing chain 18*a*–18*n*, added strength is given to the system should a rail section 12*a*–12*n* start to tip over. A carabiner or other suitable device may be substituted for the securing chains 18*a*–18*n*. The tipped-over rail section 12*a*–12*n* would then try to drag the next attached rail section 12*a*–12*n* with it and so on. The overall weight will prevent the safety rail system from tipping over. The rail lock donut 16*a*–16*n* is designed so it too can accommodate the infinite directions available to the rail sections 12*a*–12*n* as they are turned in the post receivers 36*a*–36*d* of bases 14*a*–14*n*.

The gate assemblies for the safety rail system 10 are unique in design. A gate assembly is comprised of four major components: namely, one of the gate sections 32*a*–32*n*, one of the latching posts 28*a*–28*n*, one of the gate posts 34*a*–34*n*, and a locking coupler 54. The latching post 28*a* is where a gate latch 52 will secure the gate section 32*a* so to not swing to and fro. The gate section 32*a* connects via hinges 50*a*–50*n* to the gate post 34*a*. The gate sections 32*a*–32*n* also have the capability to have infinite positions for placement and when the desired direction is found, the locking couplers 54 can easily lock the gate sections 32*a*–32*n* into position so they will not move. The locking coupler 54 is made of a lightweight metal such as aluminum. It is machined half way through to be the outside diameter of a gate post 34*a*–34*n*. The locking coupler 54 has holes 56*a*–56*b* for a securing means such as a spring pin or bolt that can be installed on the gate post 34*a*–34*n* so that the gate post 34*a*–34*n* cannot be removed. The lower interior of the locking coupler 54 is machined tapered to fit the tapered post receiver 36*a*–36*d*, or if tubing is used, it would not need to be tapered. It also has a hole 58 so that a knob can be screwed into the hole and against the post receiver so that the gate post 34*a*–34*n* will not rotate when mounted into position.

Although this invention was designed for manufacturing facilities, construction sites, and animal pens, it can be used on elevated work surfaces and meets or exceeds OSHA's regulations for fall protection on an elevated work surface. This invention has optional toe board receivers 22*a*–22*n* which are slid over and about the bottoms of each of the vertical posts 24*a*–24*b* of the rail sections 12*a*–12*n*. A toe board 20*a*–20*n*, that meets OSHA'S standards, can be secured to the board receiver bracket 66 and secured with a screw, bolt or locking pin. Once in place, the toe board receiver 22*a*–22*n* can be secured to the rail section by tightening the L-bolt 76 against the post receivers 36*a*–36*d* of bases 14*a*–14*n*. This device was also designed to have infinite directional movement before securement. No matter what position the base 14*a*–14*n* is in when the rail section 12*a*–12*n* is installed and secured, the toe board receivers 22*a*–22*n* will always be able to follow the run of the rail sections 12*a*–12*n*.

The bases 14*a*–14*n* are of a cast iron design or welded design to meet the weight requirements. They have enough weight that when varying lengths of rail sections 12*a*–12*n* or gate sections 32*a*–32*n* are secured to the post receivers 36*a*–36*d*, the safety rail system 10 can withstand a minimum of 250 pounds of pressure from any angle. This feature allows the system to be in compliance with OSHA's Fall Protection Regulations. Each of the bases 14*a*–14*n* has four post receivers 36*a*–36*d* which allow the bases 14*a*–14*n* to accommodate as many rail sections 12*a*–12*n*, thus creating a maximum of four quadrants emanating from each base 14*a*–14*n*. The post receivers 36*a*–36*d* have strategically positioned slots 44*a*–44*n* that enable the rail section 12*a*–12*n* to be positioned in infinite directions while setting up another base 14*a*–14*n* at the end of the rail section 12*a*–12*n*. When the rail section 12*a*–12*n* is placed into the desired position, bolts or locking pins 30 are installed through the slots 44*a*–44*n*, into the holes 48*a*–48*n* on the vertical posts 24*a*–24*b* of rail sections 12*a*–12*n*. One type of locking pin is a clevis pin with a hole at one end for a lynch pin with a ball detent. A double ring with a lanyard can connect between a top of the clevis pin and the lynch pin for operator convenience. This secures the rail sections 12*a*–12*n* in place.

Various modifications can be made to the present invention without departing from the apparent scope hereof.

SAFETY RAIL SYSTEM

PARTS LIST

10 safety rail system
12*a–n* rail sections
14*a–n* bases
16*a–n* rail lock donut
18*a–n* securing chain
20*a–n* toe boards
22*a–n* toe board receivers
23*a–n* horizontal rails (of rail sections)
24*a–b* vertical posts (of rail sections)
25*a–n* horizontal rails (of gate sections)
26*a–b* vertical posts (of gate sections)
28*a–n* latching posts
30 locking pin
32*a–n* gate sections
34*a–n* gate posts
36*a–d* post receivers
38*a–d* holes
40*a–d* cutouts
42 planar portion
44*a–n* slots
46 lifting bar
48*a–n* holes
50*a–n* hinges
52 gate latch
54 locking coupler
56*a–b* holes
58 hole
60 hole
62*a–b* slots
64 sleeve
66 board receiver bracket
68 shaft
70*a–b* holes
74 nut
76 L-bolt
78 dig site

What is claimed is:

1. A safety rail system including a base, the base comprising:

a. a plate;

b. at least one cutout in said plate;

c. at least one hole through said plate spaced from said at least one cutout;

d. a lifting bar on said plate;

e. at least one post receiver extending upwardly from said plate for receiving a post with holes in a lower end; and, f. a plurality of offset slots in each said at least one post receiver for receipt of a pin to be pushed therethrough and into a hole of a post.

2. The safety rail system of claim 1, further including a post in said at least one post receiver and a rail lock means on said post.

3. A safety rail system comprising:

a. at least two plates, at least one cutout in each plate, at least one hole through each plate spaced from said at least one cutout, a lifting bar on each plate, a plurality of upwardly extending post receivers on each plate, each post receiver for receiving a post with holes in a lower end, and a plurality of offset slots in each post receiver for receipt of a pin to be pushed therethrough and into a hole of a post; and, b. at least one gate assembly engaged into post receivers on two of said at least two plates.

4. A safety rail system comprising:

a. at least two plates, at least one cutout in each plate, at least one hole through each plate spaced from said at least one cutout, a lifting bar on each plate, a plurality of upwardly extending post receivers on each plate, each post receiver for receiving a post with holes in a lower end, and a plurality of offset slots in each post receiver for receipt of a pin to be pushed therethrough and into a hole of a post;

b. at least one gate assembly engaged into post receivers on two of said at least two plates; and, c. rail lock means on each end of said at least one gate assembly.

5. A safety rail system comprising:

a. at least two plates, at least one cutout in each plate, at least one hole through each plate spaced from said at least one cutout, a lifting bar on each plate, a plurality of upwardly extending post receivers on each plate, each post receiver for receiving a post with holes in a lower end, and a plurality of offset slots in each post receiver for receipt of a pin to be pushed therethrough and into a hole of a post;

b. at least one rail section engaged into post receivers on two of said at least two plates; and, c. at least one toe board means engaged between opposing ends of said at least one rail section.

6. A safety rail system including a base, the base comprising:

a. a plate;

b. four spaced cutouts in said plate;

c. a lifting bar centered in said plate;

d. four spaced post receivers on said plate each for receiving a post with holes in a lower end; and, e. a plurality of slots in a plane in each post receiver for receipt of a pin to be pushed therethrough and into a hole of a post.

7. A base for a safety rail system, comprising:

a. a plate; and, b. a plurality of post receivers extending upwardly from said plate, each post receiver for receiving a vertical post having holes in a lower end, and each post receiver including a plurality of offset slots for receipt of a pin to be pushed therethrough and into a hole of said vertical post.

8. A base for a safety rail system, comprising:

a. a plate;

b. a cutout in said plate;

c. a hole through said plate spaced from said cutout;

d. a lifting bar on said plate; and, e. a post receiver extending upwardly from said plate and having a plurality of offset slots.

9. A base for a safety rail system, comprising:

a. a plate having a top surface and a bottom surface;

b. a lifting bar located at the approximate center of the top surface of said plate;

c. cutouts in said plate for use in lifting said plate, said cutouts extending through said plate from said top surface to said bottom surface and being spaced at equal intervals around the periphery of said plate;

d. holes extending through said plate from said top surface to said bottom surface for receiving anchoring means for anchoring said plate to a supporting surface; and, e. four tubular post receivers extending upwardly from said top surface of said plate for receiving posts, each of said four tubular post receivers having two pairs of aligned slots, each slot lying parallel to the top surface of said plate and each slot having an arcuate length slightly greater than 90 degrees, the aligned slots of one pair being offset 90 degrees with respect to the aligned slots of the other pair and being closer to the top surface of said plate than the aligned slots of the other pair.

10. A safety rail system, comprising:

a. a plurality of bases, each base comprising a planar portion with a plurality of post receivers extending upwardly therefrom, each post receiver having a tubular portion for receiving a vertical post and a plurality of offset slots for receiving a locking pin;

b. a plurality of rail sections, each rail section comprising two vertical posts and one or more horizontal rails extending between the two vertical posts, each vertical post having a lower end with holes therethrough;

c. said lower ends of said vertical posts of said rail sections extending into respective tubular portions of respective post receivers; and, d. each vertical post being locked to its respective post receiver by a locking pin extending through a pair of said offset slots and one of said holes.

11. The safety rail system as defined in claim 10, wherein each rail section further comprises a toe board extending between its two vertical posts.

12. The safety rail system as defined in claim 11, wherein each toe board is fastened to the vertical posts of the respective rail section by toe board receivers.

13. The safety rail system as defined in claim 10, wherein each rail section includes rail lock means on each of its two vertical posts.

14. A safety rail system, comprising:

a. a plurality of bases, each base comprising a planar portion with a plurality of post receivers extending upwardly therefrom, each post receiver having a tubular portion for receiving a vertical post and a plurality of offset slots for receiving a locking pin;

b. a gate assembly, said gate assembly including a latching post having a lower end with holes therethrough, a gate post having a lower end with holes therethrough, and a gate section comprising two vertical posts and one or more horizontal rails extending between the two vertical posts, one of the vertical posts of said gate section being hinged to said gate post, and the other of said vertical posts of said gate section carrying a latch for latching to a cooperating part on said latching post;

c. said lower ends of said latching post and said gate post extending into respective tubular portions of respective post receivers; and, d. said latching post and said gate post each being locked to its respective post receiver by a separate locking pin extending through a pair of said offset slots and one of the holes in its lower end.

15. The safety rail system as defined in claim 14, wherein said gate assembly further includes a locking coupler securing said gate post against rotation relative to said post receiver into which said gate post extends.

* * * * *